United States Patent [19]

Sherwood

[11] 4,204,665

[45] May 27, 1980

[54] PANEL MOUNTING ASSEMBLY

[75] Inventor: Edward F. Sherwood, Gettysburg, Pa.

[73] Assignee: Westinghouse Electric Corp., Pittsburgh, Pa.

[21] Appl. No.: 952,520

[22] Filed: Oct. 18, 1978

[51] Int. Cl.² ..... E04H 17/14

[52] U.S. Cl. ..... 256/65; 52/509

[58] Field of Search ..... 52/506, 508, 509, 510, 52/512, 311, 127, 235, 136, 137; 248/478, 488, 448, 452; 256/65

[56] References Cited

U.S. PATENT DOCUMENTS

| | | | |
|---|---|---|---|
| 1,539,633 | 5/1925 | Benton | 40/611 |
| 3,176,947 | 4/1965 | Inverso | 248/448 |
| 3,282,004 | 11/1966 | Brounn | 52/509 |
| 3,550,894 | 12/1970 | Kaplan | 248/488 |

*Primary Examiner*—John E. Murtagh

*Attorney, Agent, or Firm*—D. R. Lackey

[57] ABSTRACT

A hung panel assembly which enables a decorative panel member to be quickly and securely mounted on a wall. The mounting arrangement includes rotatable side guide members, and support members, which cooperate to provide a secure mounting arrangement while facilitating quick removal, reversal and rehanging of the panel.

3 Claims, 9 Drawing Figures

PANEL MOUNTING ASSEMBLY

BACKGROUND OF THE INVENTION

1. Field of the Invention

The invention relates in general to new and improved panel mounting arrangements, and more specifically to arrangements for hanging decorative panels on a wall.

2. Description of the Prior Art

Panel members are often hung on a wall to provide a desired decorative effect, and it is common to utilize panels which have both major surfaces finished such that either side may be used as a decorative surface. For example, decorative panels are often hung on the walls of steel elevator cabs to provide an attractive, finished appearance. The exposed surface of a panel may become damaged through use. Thus, the ability to reverse the panel and expose the other finished surface, doubles the useful service life of a panel.

While the mounting hardware for decorative hung panels may be installed on a wall, such as on the wall of an elevator cab, at the factory, the actual hanging, and the future reversal, of a panel, is done at the job site by service personnel. Thus, it is important that the original installation, and subsequent reversal of the panels, be easily and quickly accomplished, preferably with a single installer. It is also important that the panels be firmly and securely mounted with no vibration or looseness occurring during usage thereof, even when the panels are subjected to accelerating and decelerating forces during use, such as when they are mounted in an elevator cab. Further, it is desirable that the mounting arrangement promote and maintain flatness of the panels. Finally, the mounting arrangement should provide all of the hereinbefore mentioned desirable features while being substantially concealed, when viewed from any normal viewing angle.

SUMMARY OF THE INVENTION

Briefly, the present invention is a new and improved panel mounting assembly for decorative panels, which requires only a single installer to hang a panel, or to remove a mounted panel, reverse it, and rehang it. The mounting assembly includes a lower support member fixed to the wall which is to receive the panel, an upper support member slidably fixed to the wall with a downward bias, and side guide members rotatably fixed to the wall. The panel member includes a longitudinal groove on its upper edge, and slots in its side edges. The panel member is installed by placing the panel upright adjacent to the place it is to be mounted, lifting and guiding the panel such that the upper support member engages the longitudinal slot in the upper edge of the panel, continuing to lift the panel against the downward bias until the bottom edge of the panel clears the lower support member, swinging or pivoting the bottom edge of the panel towards the wall to orient the lower end of the panel over the lower support member, and then lowering the panel onto the lower support member. The side guide members are then rotated to engage the slots in the side edges of the panel. If a panel is bowed, pressure is applied to the panel in the direction necessary to align the side guide members with the appropriate slots. The upper and lower support members, and side guide members, all cooperate to provide and maintain panel flatness. After the wall has been completed with one or more panel members hung thereon, a handrail may be mounted with an elevation which conceals the side guide members.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
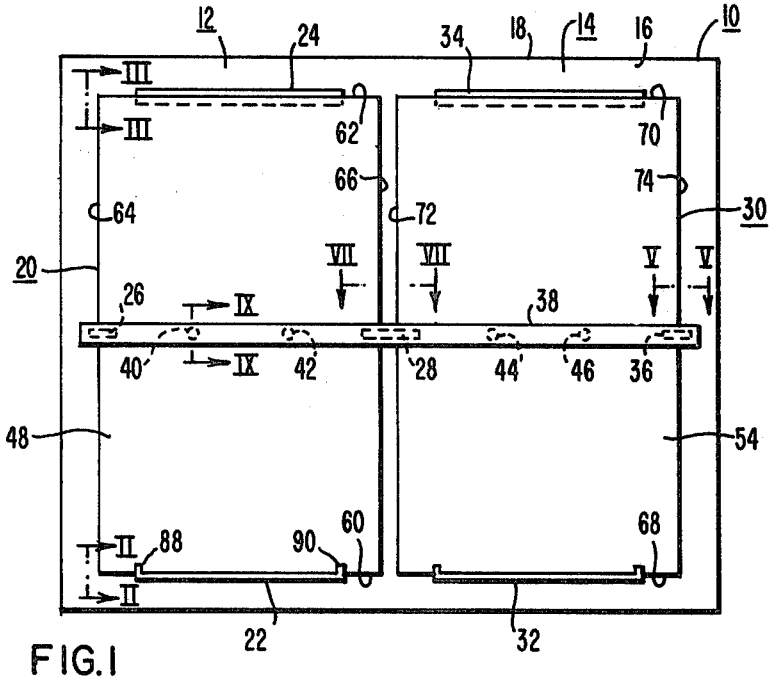
FIG. 1 is an elevational view of a wall having decorative panels hung thereon according to the teachings of the invention.

Referring now to the drawings, and to FIG. 1 in particular, there is shown a wall 10, such as a steel wall of an elevator cab, upon which one or more panel assemblies are mounted or hung, such as panel assemblies 12 and 14, respectively. Wall 10, best shown in the cross-sectional views of FIGS. 2, 3, 4, 5, 7 and 9, has first and second major opposed surfaces 16 and 18, with surface 16 being a front surface upon which the panel assemblies 12 and 14 are mounted.

Hung panel assembly 12 includes a panel member 20, lower and upper support members 22 and 24, respectively, and side guide members 26 and 28. Hung panel assembly 14 includes a panel member 30, lower and upper support members 32 and 34, respectively, and side guide members 28 and 36. It will be noted that side guide member 28 functions to align and guide both of the panel members 20 and 30. A handrail 38 may be mounted to conceal the side guide members 26, 28 and 36, such as via handrail mounting assemblies 40 and 42 associated with panel member 20, and handrail mounting assemblies 44 and 46 associated with panel member 30. The handrail mounting assemblies 40, 42, 44 and 46 are symmetrically located on their respective panel such that the same openings in the panels may be used regardless of which major side of the panel is being displayed.

Figure 2:
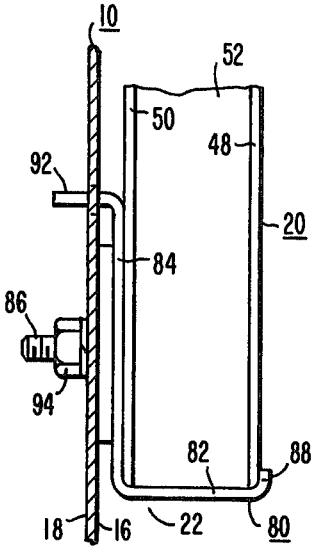
FIG. 2 is a side-elevational view of the lower support member shown in FIG. 1, taken between and in the direction of arrows II—II.
Figure 5:
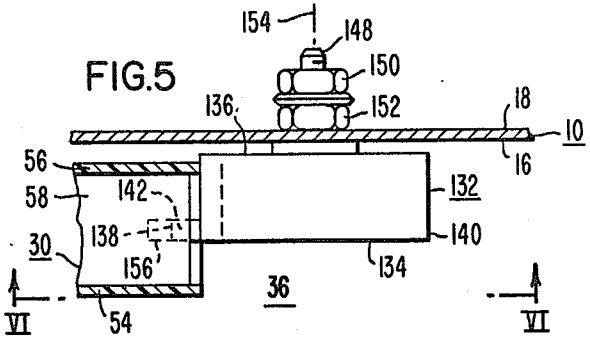
FIG. 5 is a plan view of a side guide member shown in FIG. 1, taken between and in the direction of arrows V—V.

Panel members 20 and 30 may each have two finished decorative major surfaces or sides. For example, as best shown in FIG. 2, panel member 20 has finished sides 48 and 50 disposed on a supportive core 52. As best shown in FIG. 5, panel member 30 has finished sides 54 and 56 disposed on a supportive core 58. Panel member 20, in addition to its major opposed surfaces 48 and 50, includes lower and upper edges 60 and 62, respectively, and side edges 64 and 66. Panel member 30, in addition to its major opposed surfaces 54 and 56, includes lower and upper edges 68 and 70, respectively, and side edges 72 and 74.

Since the lower and upper support members are the same for each panel member, only the lower and upper support members 22 and 24 for panel member 20 will be described in detail. The lower support member 22 is shown in FIG. 2, with FIG. 2 being a side-elevational view of the lower support assembly 22, taken between and in the direction of arrows II—II in FIG. 1. The function of the lower support member is to provide a fixed shelf which will support the complete weight of a panel while spacing the panel by a desired dimension from side 16 of wall 10. Further, it should be universal from the standpoint of being applicable to mounting a panel without regard to which major side or surface of the panel is exposed.

More specifically, as shown in FIG. 2, the lower support assembly 22 may include an elongated member 80 which has a generally L-shaped cross-sectional configuration. A first portion 82 of the L-shaped configuration forms a shelf or base for receiving the bottom edge 60 of panel 20, and a second portion 84 of angle member 80 forms a surface against which a major side of panel member 20 rests. A plurality of horizontally spaced threaded stud members, such as stud member 86, are welded or otherwise secured to the second portion 84 such that they extend outwardly therefrom in a direction which is opposite to the direction of the first portion 82.

The first portion 82 may include a pair of upstanding lip-like portions 88 and 90, which are spaced horizontally from the second portion 84 by a dimension selected to snugly receive the thickness dimension of the panel. Alternatively, a single lip may be provided along the complete length of the first portion 82, as desired.

The second portion 84 may include a pair of outwardly extending arm portions, such as arm portion 92, which extends in the same direction as stud 86. Thus, angle member 80 may be formed from an elongated flat sheet steel member having a generally rectangular configuration except for the two arm portions which extend outwardly from one of the elongated sides of the rectangular configuration. Three parallel-spaced bends will then form angle member 80.

The wall 10 is punched or otherwise prepared at the factory to include openings for receiving the studs 86, and horizontally oriented, elongated slots for receiving the pair of arm portions, such as arm portion 92. The lower support assembly 22 is assembled by placing a spacer member 94 on the studs, if required, and then the studs and arm portions are inserted through the holes and slots, respectively, in wall 10. Nuts are assembled on the threaded studs, such as nut 94, to firmly secure the angle member 80 against surface 16 of wall 10. The arm portions, such as arm portion 92, extending through the slots in wall 10, aid in providing mechanical strength for the angle member, and also automatically provide the desired horizontal orientation of angle member 80.

Figure 4:
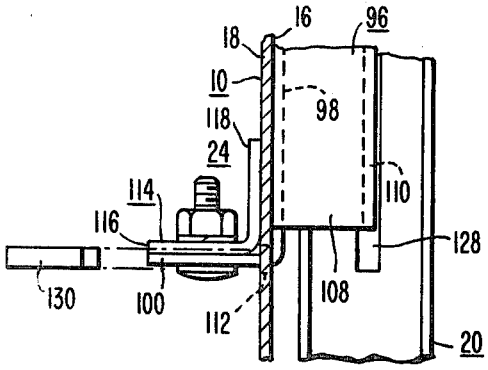
FIG. 4 is a plan view of the upper support member shown in FIGS. 1 and 3, taken between and in the direction of arrows IV—IV in FIG. 3.
Figure 3:
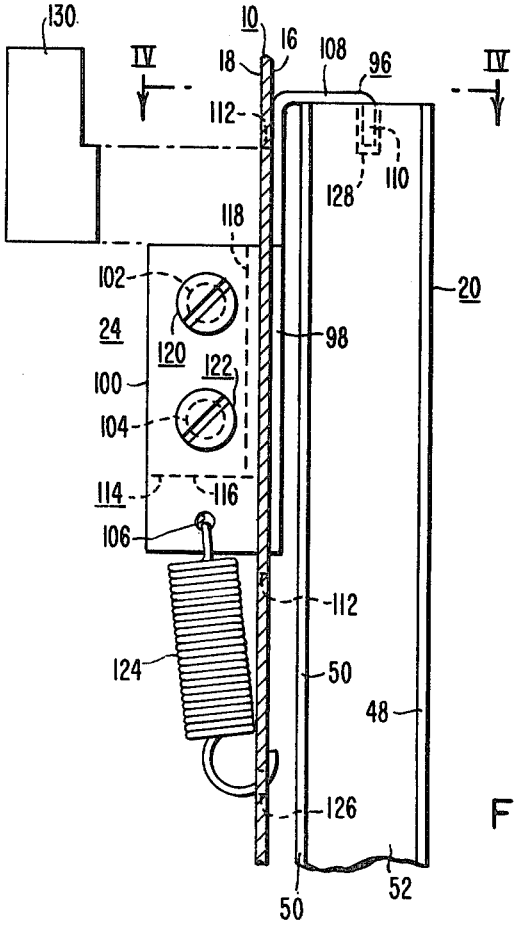
FIG. 3 is a side-elevational view of the upper support member shown in FIG. 1, taken between and in the direction of arrows III—III.

The upper support assembly 24 is shown in FIGS. 3 and 4, with FIG. 3 being a side-elevational view, taken between and in the direction of arrows III—III in FIG. 1, and with FIG. 4 being a plan view taken between and in the direction of arrows IV—IV in FIG. 3. The upper support assembly 24 includes an angle member 96 which has an elongated flat back portion 98, the ends of which are bent in a common direction, along bend lines which are perpendicular to the longitudinal dimension of the back portion, to form two spaced arm portions, such as arm portion 100. The two spaced arm portions extend outwardly such that their major surfaces are perpendicular to the major surface of back portion 98. Each arm portion has two spaced openings, such as openings 102 and 104 in arm portion 100, for receiving fastener hardware, and a smaller opening, such as opening 106 in arm portion 100, for receiving one end of biasing means, to be hereinafter described. The elongated back portion 98 terminates at its upper edge with a right angle bend which forms an outwardly extending portion 108, which extends outwardly on the opposite side of back portion 98 from the arm portions. Outwardly extending portion 108 terminates with a right angle bend which forms a continuous depending lip portion 110. Thus, angle member 96 may be formed from an elongated flat sheet of steel which is generally rectangular except for extensions at each end thereof which extend about half way across the width of the rectangular configuration. These extensions are bent to form the arm portions, such as the arm portion 100. Two spaced parallel bends in the longitudinal direction of the elongated flat sheet of steel then form portions 108 and 110.

Wall 10 includes two vertically oriented slots spaced to receive the arm portions of angle member 96, such as slot 112 for receiving arm portion 100. The vertical dimension of slot 112 exceeds the vertical dimension of arm portion 100 by a preselected amount, for reasons which will be hereinafter explained.

The arm portions are inserted through their respective slots in wall 10, from side 16 thereof, such that the openings in the arms are on side 18 of wall 10. Two right angle sliding clips or members are fastened to the two arm portions of angle member 96, on side 18 of wall 10, to provide an assembly which is slidable in the vertical slots, but otherwise fastened to wall 10. For example, a right angle sliding clip or member 114 includes first and second leg portions 116 and 118 respectively, with leg portion 116 having openings which are aligned with openings 102 and 104 in arm portion 100. Fastener means, such as nut and bolt assemblies 120 and 122, link arm portion 100 and leg portion 116, such that leg portion 118 is positioned against side 18 of wall 10. Thus, wall 10 is sandwiched between leg portion 118 of the right angle sliding clip 114 and back portion 98 of angle member 96. The fastener means 120 and 122 are adjusted to allow the assembly to slide up and down in the vertical wall slots, such as slot 112.

Biasing means is provided for urging the assembly of the elongated angle member 96, and the right angle sliding clips 114, toward the bottom of slot 112. For example, two spring members, such as spring member 124, may be disposed to link the arm portions and wall 10. Wall 10 includes openings for receiving ends of the spring members, such as an opening 126. Thus, spring member 124 has one end hooked through opening 106 of arm portion 100, and the other end of spring member 124 is hooked through opening 126 in the wall 10. The upper support assemblies 24 and 34 are factory assembled and shipped to the job site with the wall 10. The upper edges 62 and 70 of panel members 20 and 30, respectively, are provided with longitudinal grooves, such as groove 128 in panel member 20.

In the assembly of the panel members, such as panel member 20, the panel member 20 is oriented in an upright position adjacent to the lower and upper support assemblies 22 and 24, respectively. A single installer may grasp the two panel side edges and lift the panel vertically while guiding the upper edge 62 to cause the depending portion 110 of angle member 96 to enter the longitudinal groove 128. Once portion 110 enters groove 128, the installer continues to lift the panel against the downward bias provided by the spring members 124. Once the lower edge 60 of the panel is higher than the lip 88 of angle member 80, the bottom edge of the panel is pivoted towards wall 10 to vertically orient the panel. The length of the slot 112, being longer than the vertical dimension of the arm portions, allows this relationship to occur. The panel is then lowered onto the shelf-like support provided by the fixed lower support assembly 22. The panel member 20 is now firmly and securely supported adjacent to wall 10. To prevent an unauthorized person from lifting panel member 20, insert members, such as insert member 130, are inserted into the portion of the slots 112 located above each arm portion. They are inserted into the open portion of slot 112 from side 18 of wall 10. If wall 10 is part of an elevator car, these slots may be reached from the top of the cab.

If another panel member is to be mounted on wall 10, such as panel member 30 illustrated in FIG. 1, the additional panel member would be assembled in the same manner as described relative to panel member 20.

Figure 6:
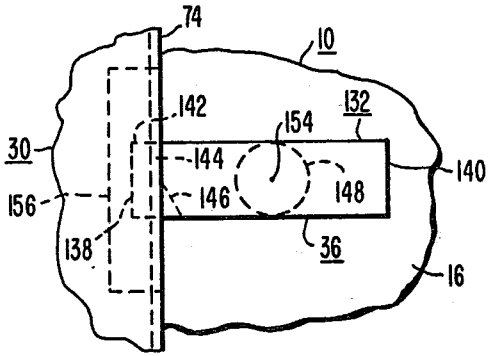
FIG. 6 is an elevational view of the side guide member shown in FIG. 5, taken between and in the direction of arrows VI—VI.

While the upper and lower support assemblies provide the complete support necessary for a panel member, in a preferred embodiment of the invention side guide members are provided which promote and maintain panel stiffness and flatness. FIGS. 5 and 6 illustrate a side guide assembly 36, with FIG. 5 being a plan view of assembly 36 shown in FIG. 1, taken between and in the direction of arrows V—V, and with FIG. 6 being an elevational view taken between and in the direction of arrows VI—VI in FIG. 5. Side guide assembly 36 includes an elongated, generally rectangularly shaped member 132, as viewed in FIG. 6, with member 32 having front and back surfaces 134 and 136, respectively, and first and second ends 138 and 140, respectively. The first end 38 includes a finger 142 which extends outwardly from the major portion of member 132, with the base of finger 142 having a first portion 144 which extends about half way across the vertical dimension of member 132, perpendicular to the upper and lower edges as viewed in FIG. 6, and a second portion 146 which angles inwardly, such as with an angle of about 30 degrees relative to a vertical line through portion 144.

A threaded stud member 148 is welded or otherwise securely fastened to the back portion 136 of member 132. An opening provided in wall 10 receives stud member 148, and fastener means, such as flange nuts 150 and 152, secure the side guide assembly 36 to wall 10. Nuts 150 and 152 are adjusted such that member 132 will remain in the position to which it is rotated about axis 154.

A slot 156 is provided in edge 74 of panel member 30, with slot 156 being just wide enough to receive finger 142, and long enough to allow finger 142 to enter and leave the slot as the side guide member is rotated about axis 154. The angled base portion 146 of finger 142 enables the base 146 to clear the edge 74 of panel member 30 as panel member 132 is rotated counterclockwise to cause finger 142 to enter slot 156. The vertically oriented base portion 144 may press against edge 74 of panel member 30, to lock the side guide assembly 36 in the operated position shown in FIGS. 5 and 6. If panel member 30 is bowed such that slot 156 and finger 142 are not aligned, pressure is applied to the panel, in the appropriate direction, until the finger and slot are aligned, permitting rotation of the side guide assembly to cause the finger to enter the slot. Thus, the side guide assembly promotes initial panel flatness and it maintains such flatness throughout the service life of the panel. The side guide assembly also adds stiffness to the panel, making it unnecessary to add support members to the wall 10.

Figure 7:
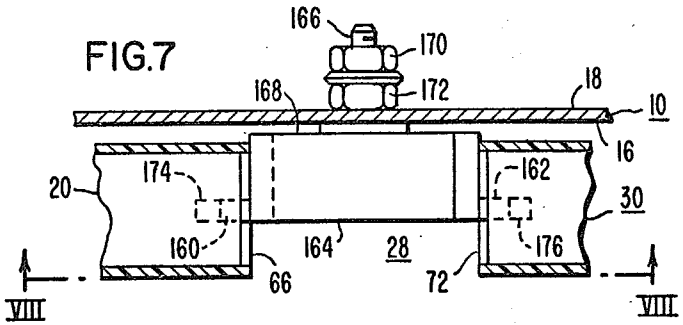
FIG. 7 is a plan view of another side guide member shown in FIG. 1, taken between and in the direction of arrows VII—VII.
Figure 8:
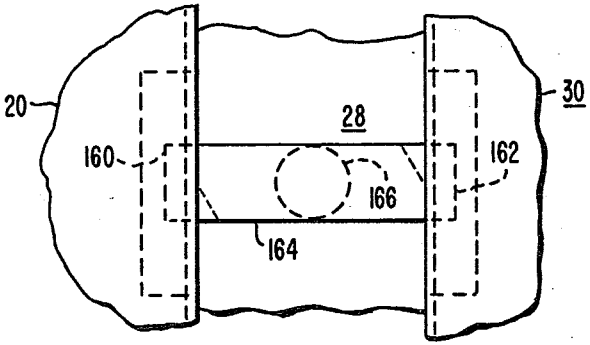
FIG. 8 is an elevational view of the side guide member shown in FIG. 7, taken between and in the direction of arrows VIII—VIII.

If panel member 30 is the only panel to be hung on wall 10, a side guide assembly similar to the side guide assembly 36 would be provided adjacent to its other side or edge 72. In the embodiment illustrated in FIG. 1, panel 30 is mounted adjacent to a panel 20, and thus the side guide assembly 28 shown in FIG. 1 may accommodate both panel members 20 and 30. FIGS. 7 and 8 illustrate the dual side guide assembly 28, with FIG. 7 being a plan view thereof taken between and in the direction of arrows VII—VII in FIG. 1, and with FIG. 8 being an elevational view, taken between and in the direction of arrows VIII—VIII in FIG. 7. Guide assembly 28 is similar to guide assembly 30, just described, except guide assembly 28 includes finger portions on both ends thereof. Thus, guide assembly 28 includes fingers 160 and 162 formed on opposite ends of a block member 164, with a threaded stud 166 being welded to the back surface 168 of member 164. The stud 166 is inserted through an appropriate opening in wall 10 and secured thereto with flange nuts 170 and 172. Slots 174 and 176 are provided in edges 66 and 72 of panel members 20 and 30, respectively, for receiving fingers 160 and 162, respectively.

The remaining side guide assembly 26 is similar to guide assembly 36, hereinbefore described.

The side guide assemblies 26, 28 and 36 may be concealed when viewed from a normal viewing angle by a handrail 38 which may be mounted on panels 20 and 30, after they have been hung on wall 10. For example, handrail 38 may be mounted on suitable mounting post assemblies, such as those illustrated generally at 40, 42, 44 and 46. The mounting post assemblies for handrail 38 are illustrated with two per panel, but only one per panel may be used, if desired, or more than two. However, regardless of the number of mounting post assemblies used per panel, they are located such that associated openings in the panels for receiving the post assemblies are symmetrical, enabling the same openings to be used regardless of which side of the panel is displayed.

Figure 9:
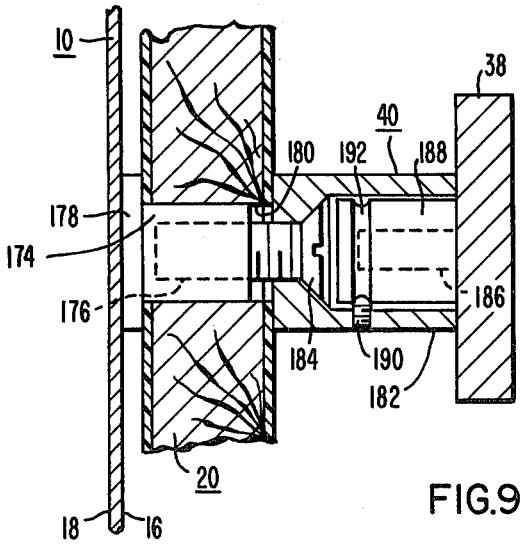
FIG. 9 is a side-elevational view, partially in section, of a handrail and a handrail support assembly shown in FIG. 1, taken between and in the direction of arrows IX—IX.

FIG. 9 illustrates an exemplary construction for mounting post assembly 40, with FIG. 9 being a partially cross-sectional view of assembly 40 taken between and in the direction of arrows IX—IX in FIG. 1. Post assembly 40 may include a cylindrical member 174 which has a threaded opening 176 accessible from one end thereof, and a flange member 178 disposed at its other end. An opening 180 is provided in panel 20 which is sized to snugly receive the diameter of cylindrical member 174. Member 174 is inserted into opening 180 before panel member 20 is hung. Then, a hollow post or standoff member 182 is aligned with opening 180, and a screw 184 is inserted into the opening of post member 182. The opening in post member 182 is formed to allow the head of the screw 184 to extend for only a predetermined dimension into the opening, with the threaded end of the screw extending past the end of the post member 182. The screw 184 is threadably engaged with the internal threads 176 of member 174, to firmly secure post 182 against panel member 20. When each post has been secured in this manner to the panels 20 and 30, the panels are then ready for hanging, using the procedure hereinbefore described. Once the panel members are hung, the side guides are rotated into the locked positions, enabling handrail 38 to be installed. As illustrated, handrail 38 may include a plurality of threaded studs, such as stud 186, which are welded or otherwise secured to the handrail. A plurality of cylindrical members, such as cylindrical member 188, having threaded openings sized to enable them to be screwed onto the studs, are then assembled with the studs. The post 182 has a set screw 190 which extends through the side wall portion into its internal opening, with the set screw 190 being oriented such that it is not noticeable, but may be easily reached by the installer, such as by being oriented to the bottom. The cylindrical members include a circumferential groove adjacent to their outwardly extending ends, such as groove 192 in member 188, for receiving the ends of a set screw. Thus, to assemble the handrail, the cylindrical members are aligned with the openings in the posts and they are then inserted therein. The set screws are advanced until they enter the groove, to firmly secure the handrail 38 to the posts.

I claim as my invention:

1. A hung panel assembly, comprising:

a wall having front and back sides, a fixed bottom support member on the front side of said wall, a downwardly biased, vertically slidable top support member upon said wall having a depending leg portion spaced from the front side of said wall, a first panel member having first and second major opposed surfaces, and side, top and bottom edges, said top edge having a longitudinal groove therein, at least one of the side edges of the first panel member has a slot therein, said first panel member being supported between said top and bottom support members, with the depending leg portion of the top support member extending into the groove in the top edge of said panel member, said first panel member being removable from said bottom and top support members by an upward movement thereof having sufficient force to overcome the downward bias of said support member, a panel side guide member having an outwardly extending finger, such guide member being rotatably fixed to the wall such that the finger may be rotated into and out of engagement with the slot in the side edge of the panel, and a handrail fixed to the first panel member at an elevation selected to at least partially conceal the side guide member.

2. A hung panel assembly, comprising:

a wall having front and back sides, a fixed bottom support member on the front side of said wall, a downwardly biased, vertically slidable top support member upon said wall having a depending leg portion spaced from the front side of said wall, and a first panel member having first and second major opposed surfaces, at least one opening, and side, top and bottom edges, said top edge having a longitudinal groove therein, said first panel member being supported between said top and bottom support members, with the depending leg portion of the top support member extending into the groove in the top edge of said panel member, said first panel member being removable from said bottom and top support members by an upward movement thereof having sufficient force to overcome the downward bias of said support member, and a handrail fixed to the panel member via said at least one opening therein, which is located such that the same opening may be used to mount said handrail regardless of which major surface of the panel member is facing outwardly.

3. A hung panel assembly, comprising:

a wall having front and back sides, a fixed bottom support member on the front side of said wall, a downwardly biased, vertically slidable top support member upon said wall having a depending leg portion spaced from the front side of said wall, a first panel member having first and second major opposed surfaces, and side, top and bottom edges, said top edge having a longitudinal groove therein, said first panel member being supported between said top and bottom support members, with the depending leg portion of the top support member extending into the groove in the top edge of said panel member, said first panel member being removable from said bottom and top support members by an upward movement thereof having sufficient force to overcome the downward bias of said support member, a second panel member mounted on the wall in the same manner as the first panel member, in side-by-side spaced relation with the first panel member, said first and second panel members having slots in their facing adjacent edges, an intermediate panel guide member having first and second outwardly extending fingers, said intermediate guide member being rotatably fixed to the wall between the first and second panel members such that said first and second fingers may be rotated into and out of engagement with the slots in the facing adjacent edges of said first and second panel members, respectively, and a handrail fixed to the first and second panel members at an elevation selected to at least partially conceal the panel guide member.

* * * * *